US005664301A

United States Patent [19]

Akeno

[11] Patent Number: 5,664,301

[45] Date of Patent: Sep. 9, 1997

[54] MOLDED SURFACE FASTENER

[75] Inventor: Mitsuru Akeno, Toyama-ken, Japan

[73] Assignee: YKK Corporation, Tokyo, Japan

[21] Appl. No.: 565,895

[22] Filed: Dec. 1, 1995

[30] Foreign Application Priority Data

Dec. 2, 1994 [JP] Japan ..... 6-299321
Oct. 6, 1995 [JP] Japan ..... 7-260468

[51] Int. Cl.[6] ..... A44B 18/00

[52] U.S. Cl. ..... 24/452; 24/442; 24/447

[58] Field of Search ..... 24/452, 451, 306, 24/442, 447, 443, 450, 444, 445, 446

[56] References Cited

U.S. PATENT DOCUMENTS

| | | | |
|---|---|---|---|
| 3,266,113 | 8/1966 | Flanagan, Jr. . | |
| 3,557,413 | 1/1971 | Engle . | |
| 3,955,245 | 5/1976 | Ballin . | |
| 4,322,875 | 4/1982 | Brown et al. | 24/447 |
| 5,067,210 | 11/1991 | Kayaki | 24/442 |
| 5,077,870 | 1/1992 | Melbye et al. | 24/452 |
| 5,097,570 | 3/1992 | Gershenson . | |
| 5,131,119 | 7/1992 | Murasaki et al. | 24/452 |
| 5,212,853 | 5/1993 | Kaneko | 24/452 |

FOREIGN PATENT DOCUMENTS

| | | | |
|---|---|---|---|
| 0 567 103 | 10/1993 | European Pat. Off. . | |
| 4279103 | 10/1992 | Japan | 24/452 |

OTHER PUBLICATIONS

Velcro hook product HTH #20, as depicted in drawing and photo. 3 pages without any description & no date.

*Primary Examiner*—Victon N. Sakran
*Attorney, Agent, or Firm*—Hill, Steadman & Simpson

[57] ABSTRACT

In a structure of the surface fastener of this invention, a substrate sheet has on its surface a plurality of dimples each defining a hollow large enough to receive a companion loop, and engaging elements are integrally molded and stand from the bottom surface of the dimple. With the surface fastener of this invention, the height of the hooks in appearance is short and the flexibility of the molded surface fastener is secured, and the hooks are prevented from falling laterally and forwardly excessively so that an adequate degree of durability for repeated use can be achieved and the flexibility of the substrate sheet and reliability of molding can be improved while securing engaging strength and a high rate of engagement with a loop of the companion surface fastener.

12 Claims, 8 Drawing Sheets

MOLDED SURFACE FASTENER

BACKGROUND OF THE INVENTION

1. Field of the Invention

This invention relates to a surface fastener in which a multiplicity of engaging elements are molded on a substrate sheet by extrusion or injection molding using thermoplastic synthetic resin, and more particularly to a molded surface fastener in which short hooks have both adequate softness and strength and is very durable, while securing a high engaging rate.

2. Description of the Related Art

A molded surface fastener in which a substrate sheet and hooks are simultaneously and integrally molded by extrusion or injection molding using thermoplastic resin is disclosed in, for example, U.S. Pat. No. 4,984,339. Surface fasteners of this type have increasingly been used as fasteners for industrial materials, car or interior ornamentals, daily goods and even sanitary goods including diaper. Consequently, a variety of kinds of surface fasteners different in size and shape have been manufactured to match the use.

As is also understood from the above-mentioned U.S. Patent Specification, in any of the conventional molded type surface fasteners, unlike the woven type, a delicate shape of hooks cannot be obtained for technological difficulties in molding. Yet if hooks in very small size could be molded, only a very low degree of strength can be achieved for the same size as the hooks of monofilament of the conventional woven type surface fastener, making such molded type surface fasteners far from satisfactory for practical use. Further, according to the conventional molded hook structure, the stem is simple in cross-sectional shape and would hence tend to fall flat laterally from its base. As a result, the individual stems would not restore to its original posture after repeated use, thus lowering the rate of engagement with loops of a companion surface fastener. Therefore, in Order to secure adequate strength, it is absolutely necessary to increase the size of the individual hooks, not only making them rigid but also the number of hooks per unit area (density of hooks) being reduced to lower the rate of engagement with the companion loops.

As a solution, a new hook structure which enables a smooth touch, with the stem hardly falling flat, during the engaging and peeling operation likewise the woven type surface fastener and which increases the rate of engagement to secure adequate strength and durability is disclosed in, for example, U.S. Pat. No. 5,131,119. In the molded type surface fastener disclosed in this U.S. Patent, as shown in FIGS. 20 and 21 of the accompanying drawings, each hook 10' has a hook-shape engaging portion 12' extending forwardly from the distal end of a stem 11', which has a rear surface 11*a'* rising obliquely in a smooth curve from a substrate sheet 15' and a front surface 11*b'* rising upwardly from the substrate sheet 15', and a reinforcing rib 13' projecting from a side surface of the stem 11', the cross-sectional area of the hook 10' increasing gradually from a tip of the hook-shape engaging portion 12' toward the base of the stem 11'. The reinforcing rib 13' serves to prevent the stem 11' from falling laterally and also to enable to minimize the size of the stem 11' and the hook-shape engaging portion 12' while securing a required degree of engaging strength.

Alternatively, engaging elements of mushroom-shape can be adopted as the engaging elements instead of the hooks. Since the engaging element of this type has a great engaging strength with the companion loop and hence a desired engaging strength can be secured even if its size is minimized, it is suitable for use in which flexibility is required.

However, according to the conventional molded surface fasteners including the one exemplified by the above-mentioned U.S. Patent Specification, all of the hooks are integrally molded and standing from the flat surface of the substrate sheet. In order that the hook is inserted reliably through the companion loop, it is necessary to set a distance L' between the lower surface of the tip of the hook-shape engaging portion 12' and the surface of the substrate sheet 15' at least several times the substantial size (diameter) of a non-illustrated multifilament yarn of the companion loop in, for example, FIG. 20. Consequently, the size of the conventional hook 10' is decided in association with the size of the companion loop; for example, when the hooks having adequate softness and a very small size and suitable for a paper diaper or the like are molded, a necessary minimum distance between the tip of the hook-shape engaging portion 12' and the substrate sheet 15' for allowing the companion loops to enter is necessarily decided.

In other words, if a predetermined engaging strength is to be secured, the height of the hook 10' is naturally decided and thus it cannot be set to a lower value. In addition, if the hooks 10' stand directly from the surface of the substrate sheet 15', whole of the stem 11' is exposed to the surface of the substrate sheet 15' so that a softer touch of the surface fastener surface cannot be achieved. If the hook 10' is reduced in size, whole of the hook-shape engaging portion 12' is depressed so as to be flexed forwardly so that it cannot come into engagement with a companion loop thus considerably lowering the engaging rate of the whole surface fastener.

Meanwhile, in the case of the above-described mushroom-shape engaging element, if it is reduced in size, its stem become thin necessarily. Therefore, if such mushroom-shape engaging element engages in a so-called hanging engagement with the companion loop due to its structure, the engaging element is easy to get damaged between the engaging portion and the stem, and hence it has a low durability. Further, if the stem is made to be thin, the engaging element is easy to get bent by the pressure of the mating surface fastener, and hence the engaging elements can be hardly engaged with the loops.

Further, if the flexibility of the surface fastener is desired to be secured when the size of the hook or mush room shape engaging element is reduced as described above, the thickness of the substrate sheet has to be made thin also. However, if the thickness of the substrate sheet is set to be thin, the substrate tends to be stretched not uniformly or torn when the engaging elements of a finished surface fastener are pulled off molding cavities in a continuous molding, therefore, reliable molding cannot be performed. Even if the molding is accomplished without trouble, the molded substrate sheet becomes wavy and cannot be suitable for practical use.

SUMMARY OF THE INVENTION

It is therefore an object of this invention to provide an integrally molded surface fastener, in which the thickness of the engaging portion is secured and the height of the engaging elements can be shorter than conventional so that the engaging elements are prevented from falling laterally and forwardly excessively, and which has an adequate degree of durability for repeated use, and at the same time, the desired flexibility of the substrate sheet and the strength against tearing while securing a high rate of engagement with a loop of the companion surface fastener.

The foregoing object is accomplished by a molded surface fastener comprising a substrate sheet and a multiplicity of engaging elements molded on and projecting from one surface of the substrate sheet, wherein the substrate sheet has in the one surface a desired number of dimples at predetermined positions, and each of the engaging element has a stem rising upwardly from a bottom surface of the associated dimple and a loop engaging portion formed at a distal end of the stem. Each of the dimples has a width such that a loop of a companion surface fastener can be introduced.

Preferably, the engaging element is a hook which comprises the stem having a rear surface rising smoothly and a front surface rising upwardly, the hook shape loop engaging portion extending forwardly and curving downwardly from a distal end of the stem, and on at least one side surface of the stem a reinforcing rib. A multiplicity of reinforcing ribs may be provided to project from the surface of the substrate sheet at positions beside intermediate portions defined by pairs of engaging elements adjacent in row direction. Further, the reinforcing rib provided on the side surface of the hook may be omitted and only the independent reinforcing ribs are provided. In this case, preferably, each of the dimples has a varying depth progressively increasing from the rear surface of the preceding hook toward the succeeding hook.

Further preferably, the engaging element is a mushroom-shape engaging element having the stem rising substantially upright and the loop engaging portion protruding integrally like a flange at an upper end of the stem. And the independent reinforcing ribs are provided on the surface of the substrate sheet at positions between the pairs of spaces defined by the pairs of adjacent engaging elements.

With the above described arrangement, though the distance between a lower surface of the engaging portion of the engaging element and the base of the stem (bottom surface of the dimple) is the same as conventional, the extent to which the engaging element projects from the surface of the substrate sheet is equal to the result that the depth of the dimple is subtracted from the actual height of the engaging element. Accordingly, though it has actually the same size as conventional, the engaging element looks shorter than actual. When the engaging element of the surface fastener of this invention of the described structure comes into engagement with the companion loop, the distal end of the loop enters under the loop-engaging portion of the engaging element as guided by the associated dimple and then is guided to the base of the stem of the engaging element so that the hook-shape engaging portion is smoothly inserted into the loop, securing the same rate of engagement with the loops as conventional.

Further, if the engaging element is a hook, the loop is automatically introduced under the hook-shape engaging portion of the hook. Namely, since the rear surface of the stem rises obliquely in a smooth curve from the dimple, the loop is introduced into the dimple along the rear surface of the stem as it is pressed against the same rear surface. The loop then automatically enters under the hook-shape engaging portion of the succeeding hook.

Still further, when the hook is made to have a varying cross-sectional area gradually reducing from the base of the stem to the tip of the hook-shape engaging portion, the projected part of the hook above the surface of the substrate sheet is relatively thin and, as a result, the hook can be flexible in spite of the same engagement force as the conventional. Yet preferably, the hook has a pair of reinforcing ribs one on each of opposite side surfaces of the stem and hence is free from being fail flat laterally. According to this invention, even in the absence of the reinforcing ribs, the base of the hook is embedded in the dimple so that it is highly unlikely for the hook to laterally fall flat as compared to the conventional hook. Further, in the case that the reinforcing ribs are provided on the surface of the substrate sheet at positions beside the intermediate portions defined by pairs of adjacent engaging elements, the reinforcing ribs serve to secure strength against tearing of the substrate sheet between the engaging elements, and also the reinforcing ribs serve as guide members to guide the companion loops under the engaging portions of the engaging elements.

In the case that the engaging element has a mushroom-like shape, even if the stem has a height and size same as those of the conventional, a part of the engaging element which projects above the surface of the substrate sheet does not completely fall flat laterally because the base of the stem stands on the bottom of the dimple, thus the engaging rate will not be lowered. Further, in the case that the reinforcing ribs are provided on the surface of the substrate sheet at positions beside the intermediate portions defined by the adjacent engaging elements, the strength against tearing of the substrate sheet between the engaging elements is secured due to the reinforcing ribs, and the reinforcing ribs serve as the guide members to guide the companion loops under the engaging portions of the engaging elements.

DETAILED DESCRIPTION OF THE PREFERRED EMBODIMENTS

Figure 1:
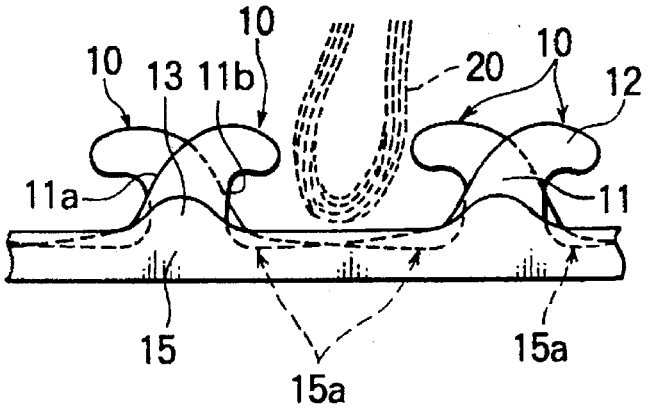
FIG. 1 is a fragmentary side view of a molded surface fastener according to a typical embodiment of this invention.
Figure 2:
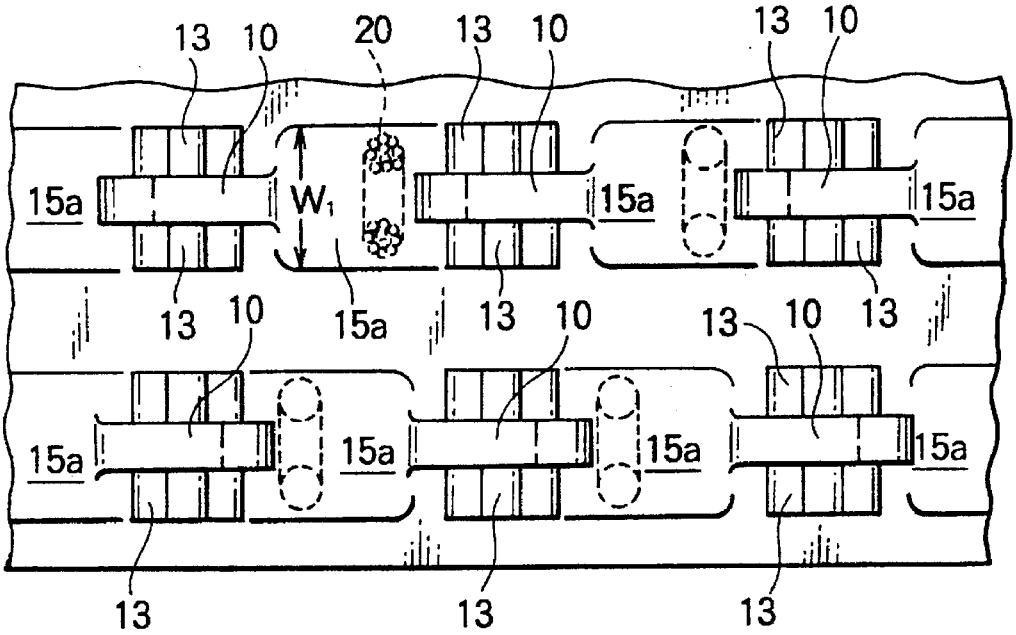
FIG. 2 is a fragmentary plan view of the surface fastener off FIG. 1.
Figure 3:
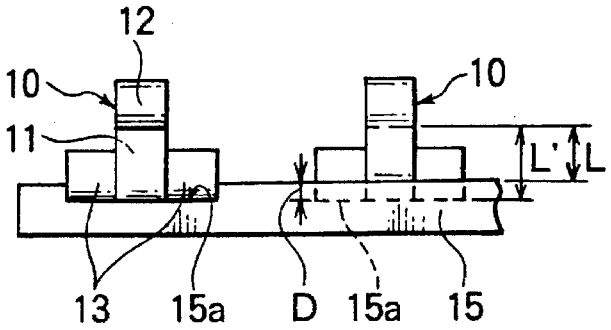
FIG. 3 is a fragmentary front view of the surface fastener of FIG. 1.

Various preferred embodiments of this invention will now be described in detail. FIG. 1 is a fragmentary side view of a surface fastener having a typical hook structure of this invention. FIG. 2 is a plan view of FIG. 1. FIG. 3 is a front view of FIG. 1.

As shown in FIGS. 1 through 3, a multiplicity of hooks 10 are molded in rows on one surface of a substrate sheet 15. In the illustrated example, the hooks 10 in the same row have a common direction, and the hooks 10 in adjacent rows have opposite directions. Each hook 10 and part of the substrate sheet 15 where the hooks are disposed are uniform in structure in every row, so the following description is limited to only a part of the surface fastener.

In the surface of the substrate sheet 15 at positions where rows of hooks 10 are formed, generally rectangular dimples 15*a* are formed at predetermined distances along every row. A bottom surface of each dimple 15*a* includes at its front and rear ends the respective bases of a front surface 11*b* and a rear surface 11*a* of the preceding and succeeding hooks 10 of each adjacent pair. Specifically, in two adjacent hooks 10 in the same row, as indicated in dotted lines in FIG. 1, the front surface of the base of the stem 11 of the succeeding hook 10 rises rearwardly in a predetermined curvature from the bottom surface of the dimple 15*a* in the substrate sheet 15 while the rear surface of the base of the stem 11 of the preceding hook 10 progressively rising forwardly in a smooth curve from the bottom surface of the same dimple 15*a*. And each hook 10 has a downwardly curving hook-shape engaging portion 12 extending forwardly from the distal end of the stem 11, and the upper majority of the stem 11 and whole of the hook-shape engaging portion 12 project above the surface of the substrate sheet 15.

Further, in the illustrated example, the hook 10 has a pair of first reinforcing ribs 13 on each of opposite side surfaces of the stem 11, each first reinforcing rib 13 having a mound shape as viewed in side elevation. And the dimple 15*a* has width W1 equal to the distance between the opposite side surfaces of the reinforcing ribs 13. In other words, according to this embodiment, in the hook 10, as viewed from the front and rear sides in FIG. 3, the hook base including the opposite reinforcing ribs 13 integrally project upwardly from the bottom surface of the dimple 15*a* formed in the substrate sheet 15. The bottom surface of the dimple 15*a* has a varying depth gradually increasing from the rear surface 11*a* of the hook 10 toward the succeeding hook 10. With this structure, the substrate sheet 15 can bear a peeling force, when the hook 10 is to be peeled off the companion loop 20, without lowering its strength. Also in the other examples described below, the bottom surface of the dimple 15*a* has substantially the same shape.

The shape of the bottom of the dimple 15*a* is not limited to the foregoing shape but may be a simple plain surface. The dimples 15*a* adjacent in row direction may be completely separate from one another. Further, the dimples 15*a* may be arranged in a staggered manner on the substrate sheet 15, in which case, even if reinforcing ribs 13*a*, which will be described later, provided on the surface of the substrate sheet in positions beside intermediate portions defined by front and rear hooks 10, 10 are omitted, a desired strength against tearing can be secured though the flexibility is improved.

In the surface fastener of this embodiment, though the distance L' between the lower surface of the tip of the hook-shape engaging portion 12 and the base of the stem 11 (the bottom surface of the dimple 15*a*) is the same as conventional, the distance L between the lower surface of the tip of the hock-shape engaging portion 12 and the surface of the substrate sheet 15 is equal to the difference between the actual height or distance L' and the depth D of the dimple 15*a*. Accordingly, though the actual height of the hook 10 standing on the substrate sheet 15 is equal to that of the conventional, the apparent height of the hook 15 above the surface of the substrate sheet 15 is shorter by the depth D of the dimple 15*a* than the actual height. With the dimples 15*a* thus formed on the substrate sheet, the flexibility of the substrate sheet 15 can be remarkably improved though its apparent thickness is the same as the conventional. And the substate sheet 15 is not stretched or torn during the peeling of the surface fastener off the mold after the molding. As a result, the molded product does not become wavy, and hence they have quality good enough for practical use.

When the hook 10 having the foregoing structure and the companion loop 20 engage with each other, the distal end of the loop 20 reaches under the hook-shape engaging portion 12 as being led by the dimple 15 and is guided to the base of the stem 11, and then the hook-shape engaging portion 12 is inserted in the loop 20 smoothly. Therefore, there should be no difference in engaging rate comparing to the conventional.

Another advantageous feature of this embodiment resides in that the loop 20 enters by itself under the hook-shape engaging portion 12 of the hook 10. Namely, since the rear surface 11*a* of the stem 11 of the hook 10 rises obliquely in a gentle curve, the loop 20 depressed against the rear surface 11*a* is introduced into the dimple 15*a* along the rear surface 11*a* so that the loop 20 existing on the rear side of the hook 10 will enter by itself under the hook-shape engaging portion 12 of the hook 10.

Further, when the hook 10 has a varying cross-sectional area gradually decreasing from the base of the stem 11 to the tip of the hook-shape engaging portion 12, a part of the hook 10 projecting above the surface of the substrate sheet 15 is relatively thin and hence has adequate flexibility in spite of the same engaging force as the conventional hook 10'. In this embodiment, since the hook 10 has the reinforcing ribs 13 on opposite side surfaces of the stem 11, there is no fear that the hook 10 might fall flat laterally. According to this invention, even in the absence of the reinforcing ribs 13, the base of the hook 10 is embedded in the dimple 15*a* so that it is highly unlikely for the hook 10 to laterally fall flat as compared to the conventional hook 10'.

Figure 4:
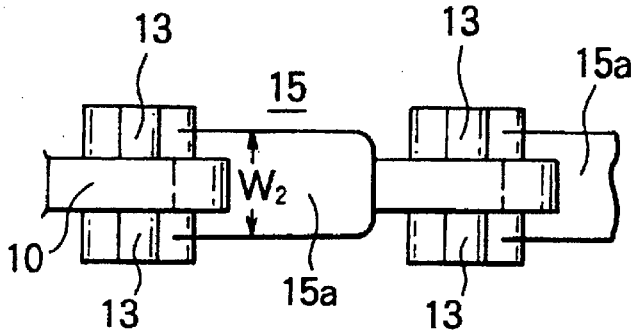
FIG. 4 is a fragmentary plan view of a first modification of the embodiment of FIG. 1.
Figure 5:
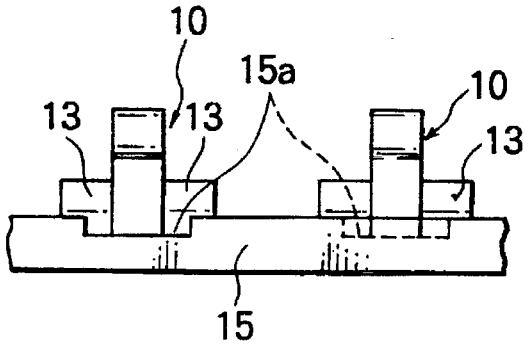
FIG. 5 is a fragmentary front view of the first modification of FIG. 4.
Figure 6:
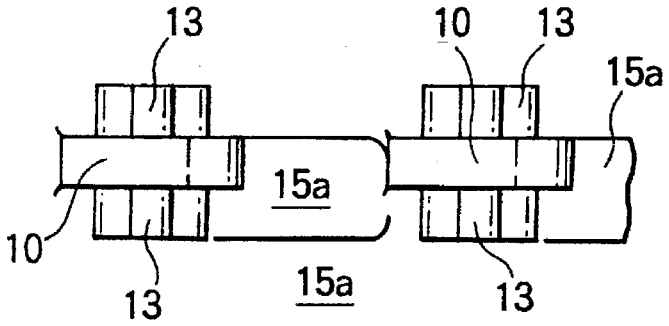
FIG. 6 is fragmentary plan view of a second modification of the embodiment of FIG. 1.
Figure 7:
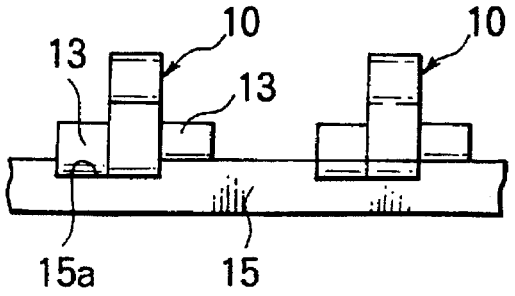
FIG. 7 is a fragmentary front view of the second modification of FIG. 6.
Figure 8:
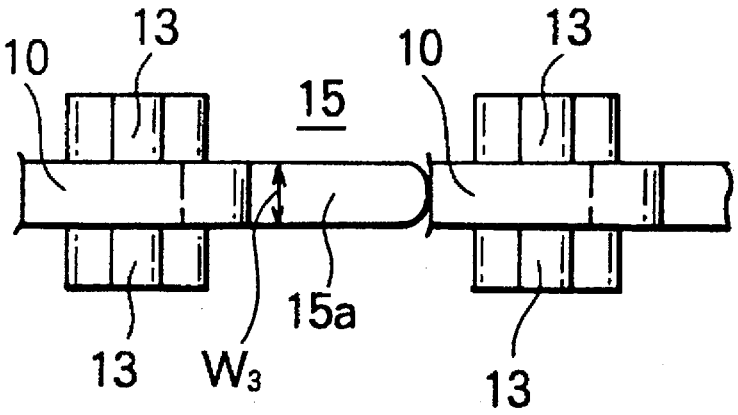
FIG. 8 is fragmentary plan view showing a third modification of embodiment of FIG. 1.
Figure 9:
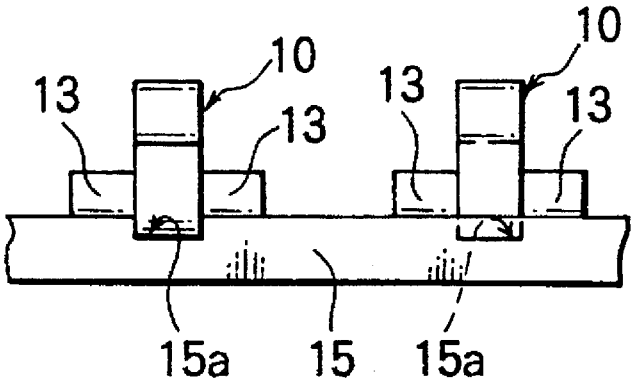
FIG. 9 is a fragmentary front view of the third modification of FIG. 8.

FIGS. 4 and 5 show a first modification of the above-mentioned embodiment. According to the modification, the dimple 15*a* has a width W2 equal to the sum of the width of half of each of the opposite reinforcing ribs 13 and the width of the hook 10 and is located centrally in the hook row. FIGS. 6 and 7 show a second modification of the first embodiment. According to the second modification, the dimple 15*a* has the same width W2 as the dimple 15*a* of the first modification, but the dimple 15*a* includes part of any of the opposite reinforcing ribs 13 and is located off the center of the hook row toward one of opposite sides. Further, FIGS. 8 and 9 show third modification of the first embodiment, in which the dimple 15*a* has the width W3 same as that of the hook 10 and is located centrally in the hook row.

Figure 10:
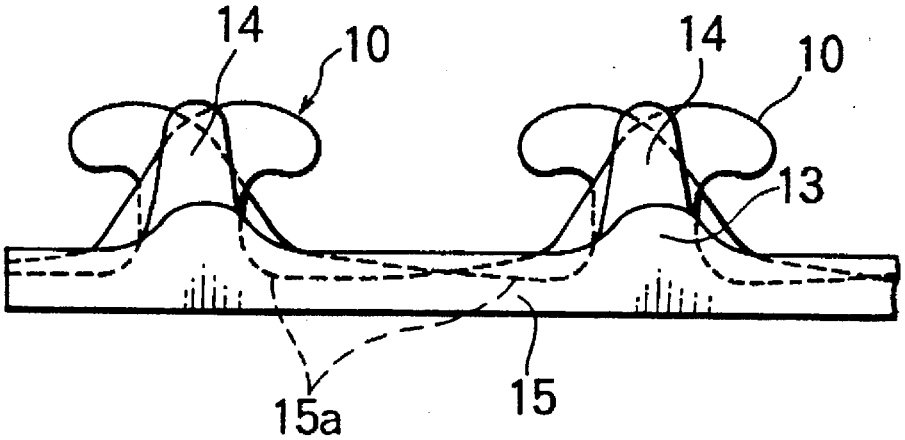
FIG. 10 is a fragmentary side view of a molded surface fastener according to another embodiment of the invention.
Figure 11:
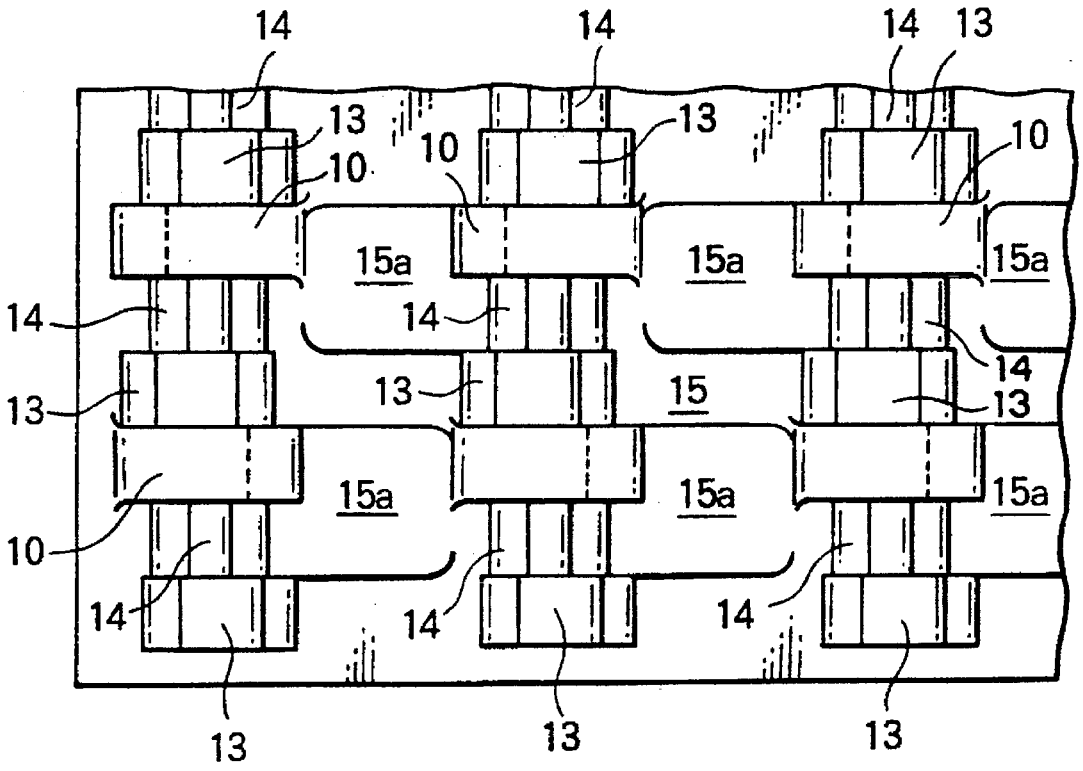
FIG. 11 is a fragmentary plan view of the surface fastener of FIG. 10.
Figure 12:
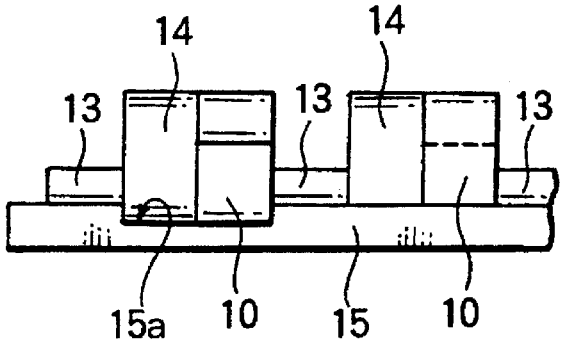
FIG. 12 is a fragmentary front view of the surface fastener of FIG. 10.

FIGS. 10 through 12 show another embodiment of this invention. According to this second embodiment, the dimple 15*a* in the substrate sheet 15 is identical in structure with the second modification described above, and there is a second reinforcing rib 14 between the mount-shape reinforcing rib 13 and the hook 10. The second reinforcing rib 14 is formed on one side surface of the stem 11 of the hook 10 at a position off the center toward the front side, having a height substantially equal to the height of the apex of the hook 10.

Figure 13:
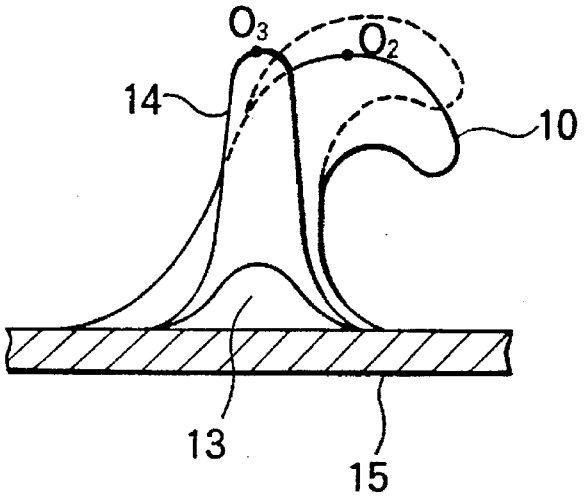
FIG. 13 shows the manner in which the shape of a hook is corrected while the molded surface fastener is molded.

In FIGS. 10 through 12, The longitudinal width of the second reinforcing rib 14 is reduced. The height of the apex $O_3$ is equal to the apex $O_2$ of the hook-shape engaging portion 12 (FIG. 13). The shape of the hook-shape engaging portion 12 indicated by dotted lines in FIG. 13 is a shape when the hook 10 is removed off, the mold. In this type of the integrally molded surface fastener, when the hooks 10 molded integrally with the substrate sheet molded on the peripheral surface of the rotary drum are drawn off the mold cavities as the drum is rotated, the hook-shape engaging portion 12 of the individual hook 10 is removed off substantially straight as shown by dotted lines in FIG. 13. But the hook-shape engaging portions 12 restores the arcuate shape of the cavities substantially the same as the original.

If the hook does not restore its original shape and has a slightly straigt shape, the hook shape can be corrected to a desired arcuate shape by heating the surface fastener after molding and depressing the heated surface fastener from the upper side while the distance between the apex $O_2$ of the hook-shape engaging portion 12 and the substrate sheet 15 is set to a predetermined distance. It is however very difficult to maintain the distance in a predetermined size during this correcting. However, according to the hook structure of this embodiment, only the hook-shape engaging portion 12 can be corrected to a predetermined arcuate shape to keep the distance between the apex $O_3$ of the hook-shape engaging portion 12 and the substrate sheet surface uniform, as the second reinforcing rib 14 assumes an upright posture when the depressing device comes into contact with the apex $O_2$ of the second reinforcing rib 14 during correcting.

Furthermore, with the first reinforcing rib 13 situated on the side surface of the base of the second reinforcing rib 14, when the hooks 10 are depressed from the upper side by the substrate sheet 15 of a companion surface having loops, even if the second reinforcing rib 14 and the stem 11 are bent laterally to one side or another, they do not bend at the base part where the first reinforcing rib 13 is disposed, so that the whole of the hook 10 is kept free from completely falling flat laterally. As a result, the once engaged loops are smoothly introduced to the first reinforcing ribs 13 at the bases of the hooks to reliably catch the hook-shape engaging portions 12 inserted through the loops, thus the rate of engagement is increased.

Figure 14:
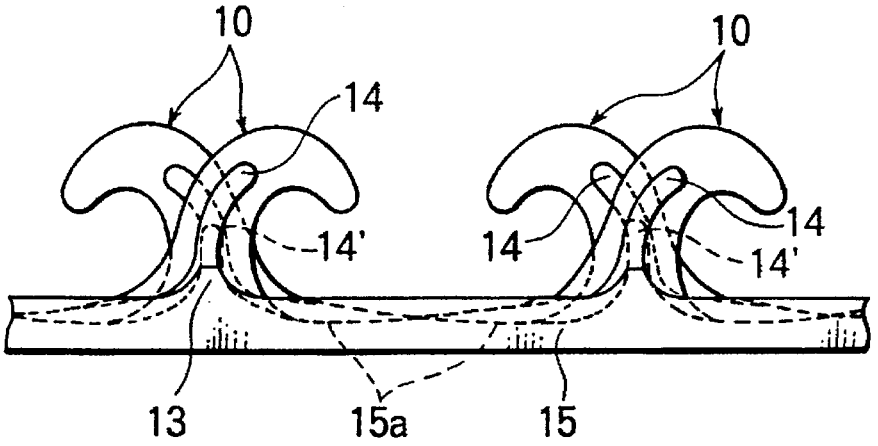
FIG. 14 is a fragmentary side view of a molded surface fastener according to still another embodiment of the invention.
Figure 15:
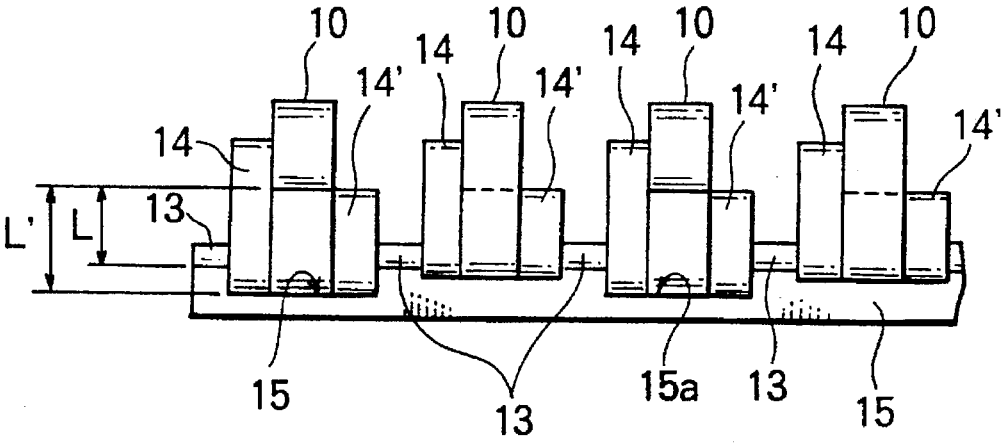
FIG. 15 is a transverse cross-sectional view of the surface fastener of FIG. 14.

FIGS. 14 and 15 show still another embodiment of this invention. According to this embodiment, the hook 10 has on opposite side surfaces first to third reinforcing ribs 13, 14, 14', and the hook 10 including the individual reinforcing ribs 13, 14, 14' is integrally formed on the substrate sheet 15 in an embedded posture in the dimple 15*a*. The first reinforcing rib 13 has a low-mound shape likewise the foregoing embodiments, and the second reinforcing rib 14 is formed between the first reinforcing rib 13 and the hook 10 and extends from the base of the stem 11 of the hook 10 to a curve 12*a* of the hook-shape engaging portion 12. The second reinforcing rib 14 has a substantially uniform width over the range from near the center to the upper end of the stem 11 and is widened gradually in the forward and backward directions from near the center to the base of the stem 11.

As is apparent from FIG. 15, in this embodiment, the hook 10 has on the other side surface of the stem 11 a third reinforcing rib 14' formed between the first reinforcing rib 13 and the hook 10. The third reinforcing rib 14' has a height substantially equal to the height of the lower surface of the tip of the hook-shape engaging portion 12 and lower than the height of the second reinforcing rib 14 formed on the opposite side of the hook 10. Each first reinforcing rib 13 is connected to the adjacent first reinforcing rib 13 by side surface.

Also in the embodiment of FIGS. 14 and 15, though the hook 10 has a height L' substantially equal to the height of the conventional hook, the projecting height L of the hook 10 above the surface of the substrate sheet 15 is equal to the difference between the actual height L' of the hook 10 and the depth of the dimple 15*a* in the substrate sheet 15. Likewise the foregoing embodiment, the part of the hook 10 projecting above the substrate sheet surface is excellent in flexibility and maintains both the conventional rate and strength of engagement with the companion loops. Since the loop is introduced surely to the hook-shape engaging portion 12 of the hook 10, the engaging rate is rather increased. Further, since the base of the hook 10 as well as the reinforcing ribs 13, 14, 14' rise from the bottom surface of the dimple 15*a*, the hook 10 is perfectly prevented from laterally falling flat from the base.

Figure 16:
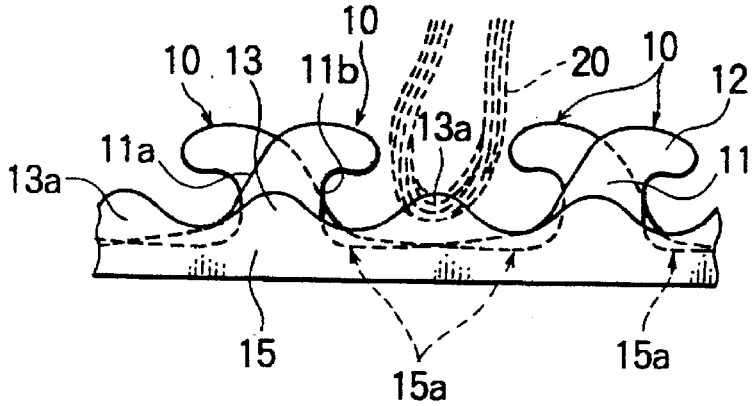
FIG. 16 is a fragmentary side view of a molded surface fastener according to still another embodiment of the invention.

Further, FIG. 16 shows another embodiment. According to FIG. 16, the pair of reinforcing ribs 13, 13 are provided on opposite sides of the hook 10 and another reinforcing rib 13*a* having mound like shape as seen from the front side is provided independently on the surface of the substrate sheet 15 at position beside intermediate portion defined by a pair of hooks 10, 10 adjacent in row direction. In this embodiment, due to the presence of the reinforcing rib 13*a*, the substrate sheet 15 necessarily obtain greater strength against tearing, and also the companion loops are guided toward the nearby engaging elements. In this case, the reinforcing rib 13 provided integrally on both sides of the hook 10 my be omitted.

Figure 17:
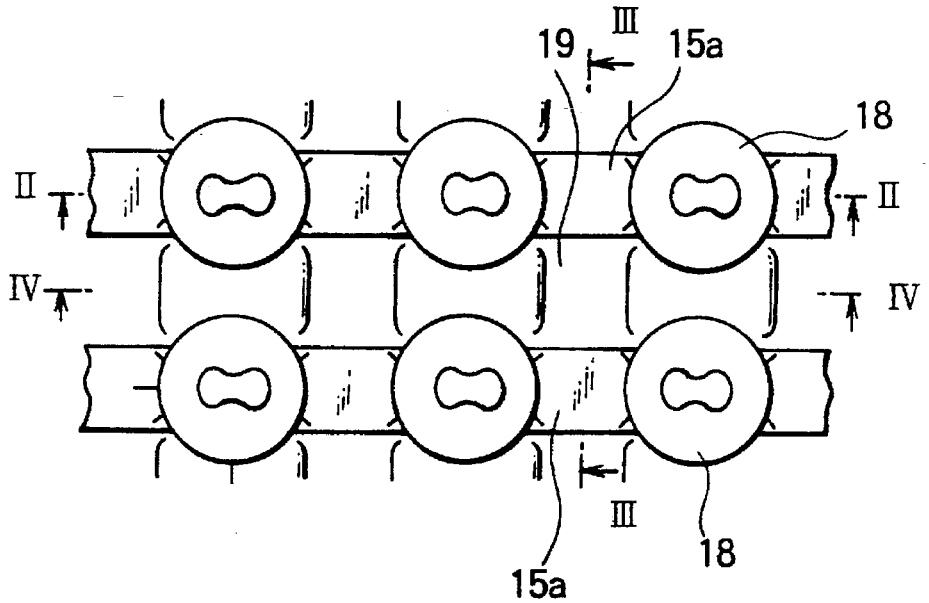
FIG. 17 is a fragmentary plan view of a molded surface fastener according to still another embodiment of the invention.
Figure 18:
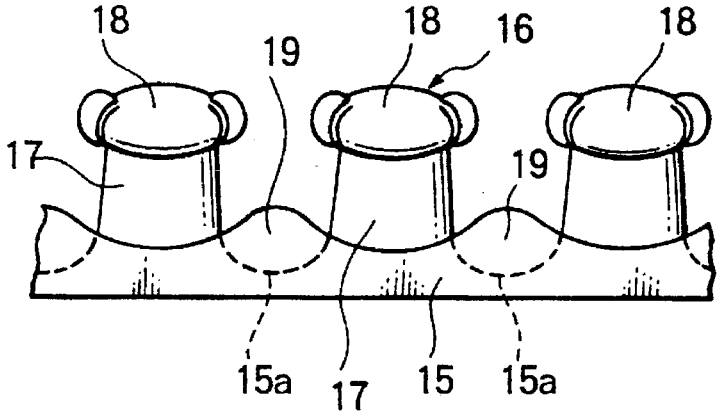
FIG. 18 is a fragmentary side view of FIG. 17.
Figure 19A:
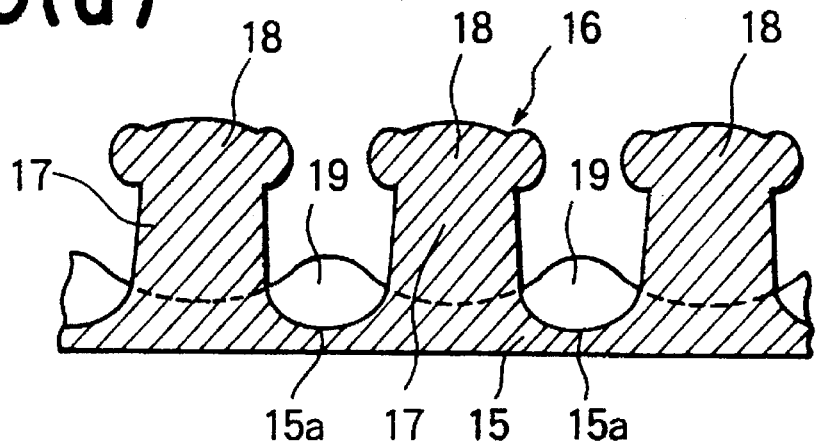
FIG. 19 is a cross-sectional view of taken along lines II—II, III—III and IV—IV of FIG. 17.
Figure 19B:
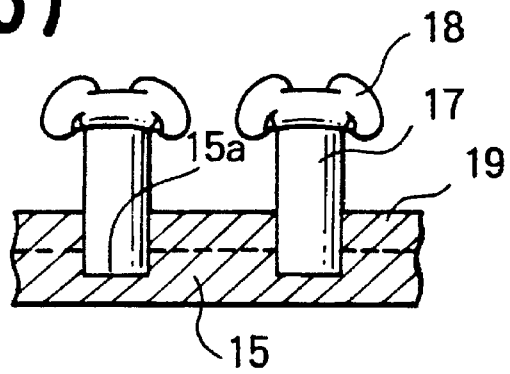
Figure 19C:
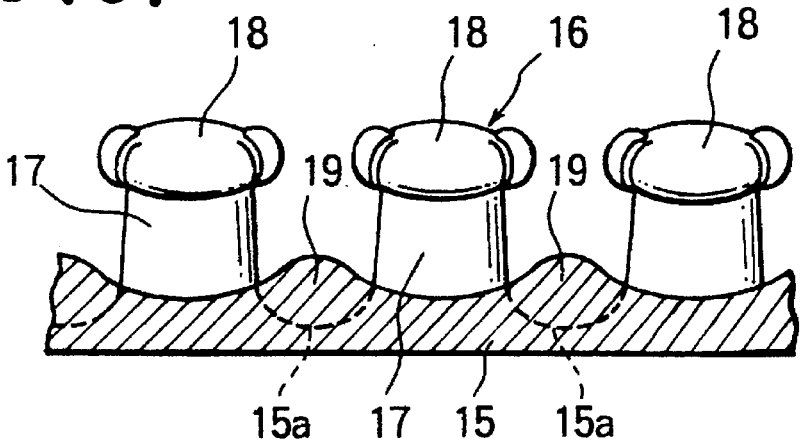
Figure 20:
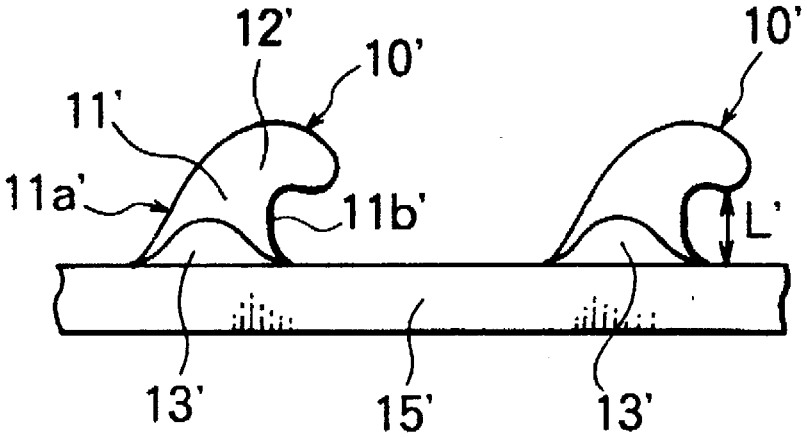
FIG. 20 is a fragmentary side view of a typical conventional molded surface fastener.
Figure 21:
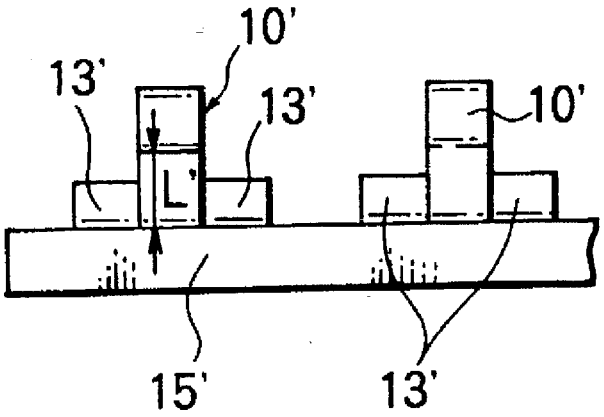
FIG. 21 is a fragmentary front view of the conventional surface fastener of FIG. 20.

FIGS. 17 through 19 show a molded surface fastener of still another typical embodiment of this invention. FIG. 17 is a fragmentary plan view of the surface fastener, FIG. 18 is a side view of FIG. 17, and FIG. 19 shows cross-sectional views along lines II—II, III—III and IV—IV of FIG. 17.

In this embodiment, a multiplicity of dimples 15*a* are formed in the substrate sheet at a predetermined interval longitudinally and transversely, like the foregoing embodiments. A mushroom-shape engaging element 16 stands upright from the bottom of each dimple 15*a*. The mushroom-shape engaging element 16 of the illustrated example comprises a cylindrical stem 17 having skirts at its front and rear and a loop engaging portion 18 having a shape of a head of the mushroom and disposed on top of the stem 17. The shape of the mushroom-shape engaging element 16 is not limited to the illustrated example, and the loop engaging portion 18 may be in a form of, for example, a simple disk-shape, a sphere or a beret. The stem 17 should not necessarily be circular in cross section, and the stem 17 may be in a form of a prism, a truncated cone or a truncated pyramid. Further, the arrangement of the dimples 15*a* should not be limited to a checkered pattern in which the dimples are disposed in regular interval longitudinally and transversely, and they may be arranged in a staggered manner.

Further in this embodiment, a reinforcing rib 19 of a mound-like shape as seen from the front side is provided longitudinally on the substrate sheet at a position beside the dimple 15*a* defined in the intermediate portion of a pair of engaging elements 16 adjacent in row longitudinally. However, the reinforcing rib 19 is not essential to this invention.

In the illustrated example with the structure as described above, though the apparent height of the engaging element is low like the foregoing embodiments, the engaging elements can have an actual height the same as that of the conventional. Therefore, hook-embracing length of the companion loop can be greater so that the engaging strength is secured and the engaging rate can be improved better than conventional. Further, due to the reinforcing rib 19 described above, the strength against tearing of the substrate sheet 15 should necessarily be increased, and at the same time, reliable molding can be accomplished and the companion loop is guided toward the nearby engaging element 16.

As is understood from the foregoing description, in this invention, various other modifications may be suggested. For example, the shape of the dimple 15*a* may be altered in various ways to meet the purpose of uses of the hook 10. Also regarding the reinforcing ribs, various shapes and combinations may be suggested, and of course, the reinforcing ribs may be omitted.

As is apparent from the foregoing description, according to the molded surface fastener of this invention, partly since the substrate sheet has in its surface a multiplicity of dimples each having a size and shape such that a loop of the companion surface fastener may be introduced into the dimple, and partly since the engaging element is formed integrally with and rises from the bottom surface of the dimple, though the actual height of the engaging element is the same as that of the conventional, the apparent height of the engaging element above the substrate sheet is shorter by the depth of the dimple than the actual height of the engaging element. Therefore, it is possible not only that the flexibility of the substrate sheet itself can be secured and the entire surface fastener has soft touch as the surface fastener has the integrally molded engaging element with the part of the engaging element projecting above the substrate sheet surface but also that the loop enters the dimple surely. Further, since the base of engaging element rises from the bottom surface of the dimple, the engaging element is prevented from laterally falling flat from the base even in the absence of reinforcing ribs, and falling to the front side is restricted by the substrate sheet surface, thus the engaging rate should be increased.

I claim:

1. A molded surface fastener comprising a substrate sheet and a multiplicity of side-by-side rows of engaging elements, for engaging loops, molded on and projecting from one surface of said substrate sheet, wherein said substrate sheet has in said one surface a corresponding number of dimples respectively associated with each of said engaging elements, and each of said engaging elements has a stem rising from a bottom surface of the associated dimple, and a loop engaging portion formed at a distal end of said stem such that the height of said engaging elements above said one surface is less than the designed height for said engaging elements.

2. A molded surface fastener according to claim 1, wherein each of said dimples has a width such that a loop of a companion surface fastener can be introduced.

3. A molded surface fastener according to claim 1, wherein a multiplicity of independent reinforcing ribs running in a rib row project from said one surface of said substrate sheet at positions beside intermediate portions defined between adjacent engaging elements running in an element row adjacent said rib row.

4. A molded surface fastener according to claim 3, wherein the level of said one surface from which said reinforcing ribs project is elevated-relative to the level of said bottom surface of the dimples from which said engaging elements rise.

5. A molded surface fastener according to claim 4, wherein each said engaging element also has on at least one side surface of its stem a stem-reinforcing rib.

6. A molded surface fastener according to claim 1, wherein said engaging element is a hook which comprises said stem having a rear surface and a front surface rising upwardly from said one surface and said loop engaging portion is a hook-shape extending forwardly and curving downwardly from a distal end of said stem.

7. A molded surface fastener according to claim 6, wherein each said hook has on at least one side surface of said stem a reinforcing rib.

8. A molded surface fastener according to claim 6, wherein said hooks consecutively follow one another, and wherein each said dimple has a varying depth progressively increasing from said rear surface of the preceding hook toward the succeeding hook.

9. A molded surface fastener according to claim 7, wherein said at least one reinforcing rib associated with said stem rises from said bottom surface of said dimple.

10. A molded surface fastener according to claim 7, wherein only a portion of said at least one reinforcing rib associated with said stem rises from said bottom surface of said dimple.

11. A molded surface fastener according to claim 7, wherein a multiplicity of independent reinforcing ribs project from said one surface of said substrate sheet at positions beside intermediate portions defined between adjacent engaging elements.

12. A molded surface fastener according to claim 1, wherein said engaging element is a mushroom-shape engaging element having said stem rising substantially upright and said loop engaging portion protruding integrally like a flange at an upper end of said stem.

* * * * *